United States Patent [19]

Newman, Jr. et al.

[11] 3,942,331

[45] Mar. 9, 1976

[54] CRYOGENIC TANK

[75] Inventors: Ritchey O. Newman, Jr.; Thomas W. McCullough, both of Midland, Mich.

[73] Assignee: The Dow Chemical Company, Midland, Mich.

[22] Filed: July 8, 1974

[21] Appl. No.: 486,720

[52] U.S. Cl. ..... 62/45; 73/40.7; 220/9 LG; 220/9 C

[51] Int. Cl.[2] ..... F17C 7/02

[58] Field of Search ..... 62/45, DIG. 13; 220/9 LG, 220/9 C, 15, 18; 73/40.7

[56] References Cited

UNITED STATES PATENTS

| | | | |
|---|---|---|---|
| 2,593,916 | 4/1952 | Peff | 62/DIG. 13 |
| 2,969,092 | 1/1961 | Johnston et al. | 62/45 X |
| 3,018,016 | 1/1962 | Hnilicka, Jr. | 62/DIG. 13 |
| 3,114,469 | 12/1963 | Francis et al. | 220/9 C |
| 3,130,561 | 4/1964 | Hnilicka, Jr. | 62/45 X |
| 3,147,878 | 9/1964 | Wissmiller | 220/9 LG |
| 3,231,125 | 1/1966 | Sigona | 220/9 C |
| 3,256,000 | 6/1966 | Howlett, Jr. | 220/9 C |
| 3,257,265 | 6/1966 | Isenberg | 220/9 LG X |
| 3,395,548 | 8/1968 | Yearwood | 62/45 |
| 3,627,164 | 12/1971 | Wilson | 62/45 X |
| 3,655,086 | 4/1972 | Trenner | 220/9 LG |
| 3,695,483 | 10/1972 | Pogorski | 220/9 LG |

*Primary Examiner*—William F. O'Dea
*Assistant Examiner*—Ronald C. Capossela
*Attorney, Agent, or Firm*—Robert B. Ingraham

[57] ABSTRACT

An improved cryogenic tank is provided which has insulation secured to the inner surface of the tank and a relatively thin sealing membrane within the tank to contain cryogenic liquid. Space containing the insulation is maintained at a reduced pressure sufficient to maintain the insulation in engagement with the outer tank wall.

4 Claims, 3 Drawing Figures

CRYOGENIC TANK

Cryogenic tanks having internal insulation and a relatively thin sealing membrane disposed within the insulation have been found desirable for use with cryogenic liquids. Generally such tanks have a relatively thick outer shell which provides the desired strength to the tank and an internal thermal insulation such as plastic foam and the like. The innermost surface of the tank is a low strength wall of either thin metal or synthetic resinous material such as polyester film or sheeting which prevents a liquid contained within the tank from directly contacting the insulation or outer tank wall. Such an insulated tank may be readily prepared. However, on filling of the tank with cryogenic liquid the thin inner membrane contracts and the foam insulation contracts while the outer tank wall remains at close to ambient temperature. As a result of the thermal contraction, stresses are set up which tend to separate the insulation from the outer tank wall. Oftentimes such a separation occurs in a tank which is supported on a fixed base; such tanks, however, are still useable. Separation of the insulation from the outer tank wall can present serious problems when the tank is employed as a mobile container; that is, on a tank truck or on board a ship. Oftentimes minor leakage or permeation occurs of the cryogenic liquid through the inner sealing membrane or inner tank wall and the location of the general area of the leak is frequently extremely difficult to establish.

It would be advantageous if there were available an improved cryogenic container having insulation disposed within the container.

It would also be desirable if there were available an improved cryogenic container wherein the inner insulation could be maintained against an exterior tank wall.

It would further be desirable if there were available an improved cryogenic container which would permit the localization of leaks through its inner surface.

These benefits and other advantages in accordance with the present invention are achieved in a cryogenic container, the cryogenic container comprising an exterior container wall, an interior container wall, the interior container wall being thin and flexible relative to the outer container wall, the inner and outer container walls being in generally fixed spaced apart relationship, a synthetic resinous cellular insulation being disposed between the inner container wall and the outer container wall, the container having closure means, the improvement which comprises a conduit in operative communication with space between the inner container wall and the outer container wall, the conduit being located generally external to the inner container wall and in combination with means to maintain a subatmospheric pressure between the inner wall and the outer wall said pressure being sufficient to distend the inner container wall and cause the inner container wall to exert sufficient pressure on the insulation to maintain said insulation in contact with an inner surface of the outer container wall.

Further features and advantages of the present invention will become more apparent from the following specification taken in connection with the drawing wherein.

Figure 1:
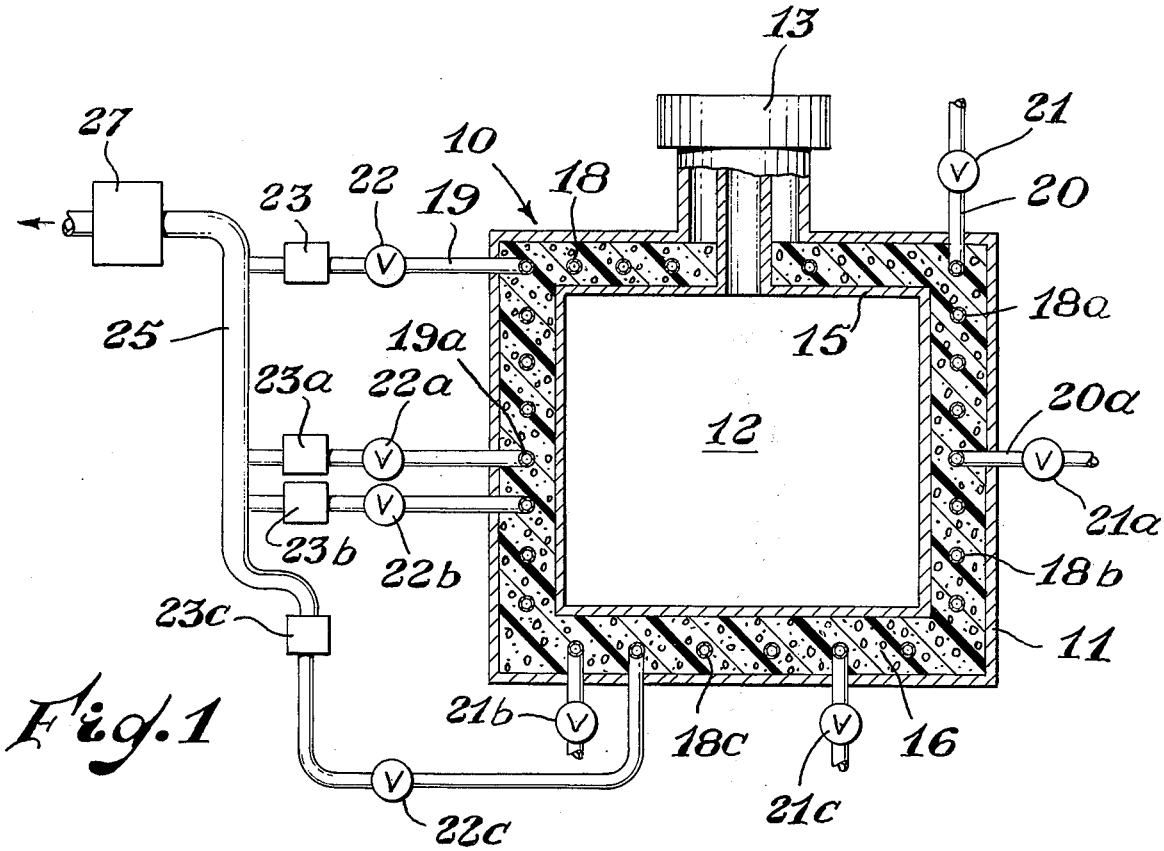
FIG. 1 is a schematic sectional representation of a container in accordance with the present invention.

In FIG. 1 there is schematically depicted a cryogenic vessel 10 in accordance with the present invention. The vessel 10 comprises a housing or outer vessel wall 11 defining therein a space or cavity 12. The vessel 10 has a closure 13 which provides optional or selective communication between the space 12 and space external to the outer vessel wall 11. An inner vessel wall 15 is disposed within the space 12 and is enclosed by the outer wall 11. The inner wall beneficially is of polyethylene terephthalate, aluminum, or the like. A cellular synthetic resinous or plastic foam insulation 16 is disposed between the outer wall 11 and the inner wall 15 and as depicted is in engagement with both the inner and outer walls. Suitable insulation is polystyrene foam, polyurethane foam, epoxy resin foam, phenolic resin foam, polyvinyl chloride foam and the like well known to the art. The insulation 16 defines a first conduit 18 generally adjacent the uppermost portion of the vessel 10. The conduit 18 has a generally spiral configuration and terminates at a first end 19 and a second end 20. The second end 20 has disposed therein a valve 21. The first end 19 has disposed therein a valve 22. The valve 22 is in operative communication with a gas detecting means 23. A second conduit **18*a* is disposed in a helical manner generally adjacent the conduit 18 and has a first end 19*a* and a second end 20*a*. The end 20*a* is in operative communication with a valve 21*a*. The first end 19*a* is in operative communication with a valve 22*a* which in turn communicates with a gas detecting means 23*a*. A similarly equipped conduit 18*b* is disposed toward the bottom of the vessel and is provided with corresponding valves 21*b*, 22 *b* and gas detecting means 23*b*. In the bottom of the vessel is a conduit 18*c*, the inner and outer walls having valves 21*c*, 22*c* and a gas detector 23*c*. The gas detecting means 23*a*, 23*b* and 23*c* are in operative communication with a vacuum header or conduit 25 which in turn is in communication with evacuating means or a vacuum pump 27.**

In operation of the vessel 10 of FIG. 1, the vacuum source 27 initially draws gases from the conduits **18, 18*a*, 18*b* and 18*c*. As the conduits are formed in synthetic resinous insulating material such as polyurethane foam (such foam has a finite permeability to gases such as air, methane and the like), the pressure in the space between the inner and outer walls is reduced by difusion or transmission of gases through the foam and the pressure in the interior of the vessel (atmospheric or greater) forces the thin inner wall outwardly against the foam insulation to maintain it in contact with both inner and outer walls. Such an arrangement provides a significant advantage in that the foam plastic insulation is held in place and adhesives or the like are not relied upon to maintain the foam in position. Mechanical working of the foam in a space between the inner and outer walls of the tank can lead to gradual degradation of the structure by abrasion or brittle failure. Advantageously, the embodiment depicted in FIG. 1 divides what might otherwise be considered a single conduit into a conduit of four zones; that is, equivalent to the conduits 18, 18*a*, 18*b*, and 18*c*. Any leakage of the liner or inner wall 15 permitting escape of the cryogenic fluid through the wall and into the synthetic resinous or plastic insulation will be localized into one of the four zones as the concentration of gas, as indicated by one of the gas detectors 23, 23*a*, 23*b* and 23*c*,** roughly localizes the damaged area. Suitable gas detectors are well known in the art. One useable gas detector for such an application is a Pirani gauge. Maintaining cryogenic tanks in accordance with the method of the present invention results in significantly less cracking of the foam insulation on cooling than is obtained when the vacuum is not applied.

Figure 2:
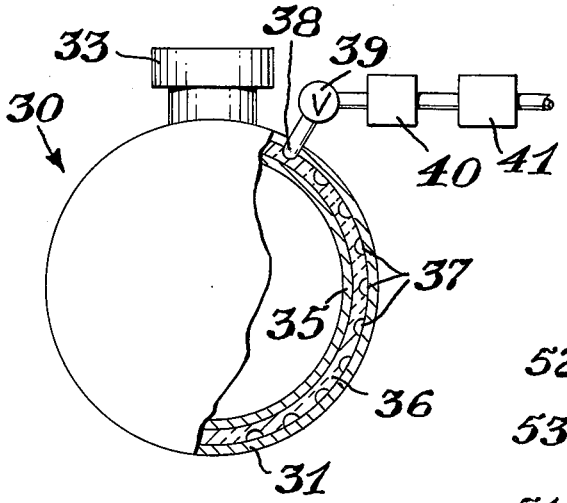
FIG. 2 is a partially sectional representation of an alternate embodiment of the invention.

In FIG. 2 there is schematically depicted a partially cutaway view of a generally spherical vessel in accordance with the present invention generally designated by the reference numeral 30. The vessel 30 comprises an outer or rigid wall 31 having defined therein a space 32. The vessel 30 has a closure 33 being in selective communication with the interior space 32. The vessel 30 has an inner wall 35 in generally fixed spaced relationship to the outer wall 31. Between the inner wall 35 and the outer wall 31 is disposed a synthetic resinous insulating member 36 defining a generally helically disposed groove 37 providing general communication between an evacuation conduit 38 and the interior of the vessel adjacent the outer wall 31. The conduit 38 has disposed therein a valve 39, a gas detector 40 and an evacuation means 41.

Operation of the vessel 30 is generally similar to that of the vessel 10 of FIG. 1 with the exception that a single zone of evacuation is provided by means of the groove 37 extending about the outer surface of the insulating material 36. The groove 37 may have any desired configuration about the surface of the insulation but a path for gas flow must be provided over at least a major portion of the outer wall 31.

Figure 3:
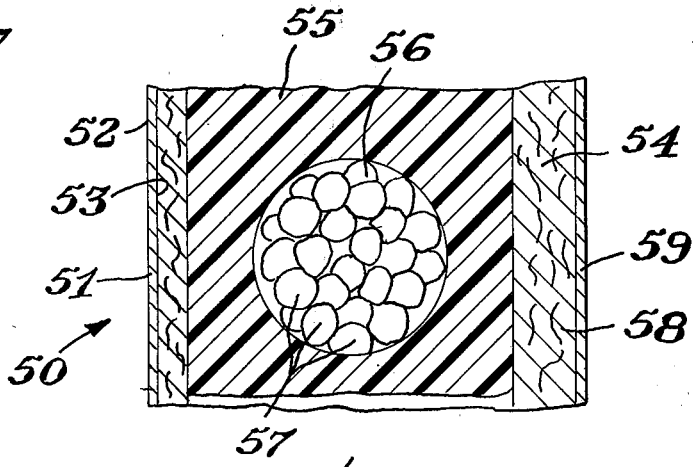
FIG. 3 is a partial sectional view of an alternate configuration of a container wall in accordance with the present invention.

FIG. 3 depicts a fractional sectional view of a vessel wall in accordance with the present invention generally designated by the reference numeral 50. The vessel wall 50 comprises a first rigid outer wall 51 having an external surface 52 and an internal surface 53. Adjacent the wall 53 is a fibrous readily gas permeable insulating material 54 such as a glass fiber batt. Adjacent the fibrous material 54 and remote from the inner surface 53 is a cellular synthetic resinous insulating member 55 having defined therein a generally centrally disposed passageway 56. The passageway 56 beneficially extends in a generally spiral or helical path within the insulation. A plurality of synthetic resinous cellular insulating particles 57 are disposed within the conduit 56. Adjacent the insulation 55 and remote from the insulation 54 is another layer of fibrous gas permeable insulation 58. A thin deformable vessel inner wall 59 is disposed adjacent the insulation 58 and remote from and generally parallel to the inner surface 53 of the outer wall 51.

The wall configuration depicted in FIG. 3 is particularly advantageous where extreme dimensional variations will occur when the tank is filled with a cryogenic liquid. The use of the fibrous thermal insulation adjacent the inner and outer skins provides a cushion for the resinous insulation 55. In the event any movement occurs abrasion of the synthetic resinous insulation 55 is significantly reduced if not entirely eliminated. The fibrous insulation provides an additional path for any gases which may permeate the inner wall 59 and also aids in the initial removal of gas. Beneficially the synthetic resinous particles 57 disposed within the conduit 56 increases the insulating value by reducing convection currents within the conduit which would serve to transfer heat from the outer wall of the tank toward the inner wall. Usually for most cryogenic tanks the reduced pressure between the inner and outer walls may be of relatively high value such as 1 and 2 pounds per square inch below atmospheric pressure. However, as the inner wall becomes more rigid, lower pressures are required to maintain sufficient deflection of the inner wall to press or grasp the insulation between the inner and outer walls. Generally pressures lower than about 7 pounds per square inch below atmospheric are not necessary.

The particular designs, dimensions and the like for cryogenic containers in accordance with the present invention are readily chosen by anyone skilled in the art of cryogenic tank design.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restictive or otherwise limiting of the present invention, excepting as it is set forth and defined in the hereto-appended claims.

What is claimed is:

1. In a cryogenic container, the cryogenic container comprising:

an exterior container wall and an interior container wall, the interior container wall being thin, deformable and flexible relative to the exterior container wall, the interior and exterior container walls being in generally fixed spaced apart relationship, a synthetic resinous cellular foam insulation being disposed between the interior container wall and the exterior container wall, the container having closure means, the improvement which comprises a conduit in operative communication with space between the interior container wall and the exterior container wall, the conduit being located generally adjacent to the exterior container wall, the conduit being in combination with means to maintain a subatmospheric pressure between the interior wall and the exterior wall, said pressure being sufficient to distend the interior container wall and exert sufficient pressure on the insulation to maintain said insulation in contact with an inner surface of the exterior container wall.

2. The container of claim 1 wherein the conduit is in communication with passageways formed within the foam insulation.

3. The container of claim 1 including a plurality of conduits external to the exterior wall, wherein said external conduits are each in communication with a conduit formed within the insulation which are in communication with space between the interior and exterior container walls.

4. The container of claim 1 including a fibrous thermally insulating material disposed between the inner wall and the outer wall adjacent the foam insulation.

* * * * *